US009187283B2

(12) United States Patent
Sano et al.

(10) Patent No.: US 9,187,283 B2
(45) Date of Patent: Nov. 17, 2015

(54) CONVEYOR DEVICE AND IMAGE RECORDING APPARATUS

(71) Applicants: Iwane Sano, Obu (JP); Masao Mimoto, Nagoya (JP); Noriyuki Kawamata, Nagoya (JP); Keisuke Wakakusa, Nagoya (JP); Jie Xiu, Nagoya (JP); Yasuhira Ota, Yatomi (JP); Shingo Ito, Kasugai (JP)

(72) Inventors: Iwane Sano, Obu (JP); Masao Mimoto, Nagoya (JP); Noriyuki Kawamata, Nagoya (JP); Keisuke Wakakusa, Nagoya (JP); Jie Xiu, Nagoya (JP); Yasuhira Ota, Yatomi (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/183,110

(22) Filed: Feb. 18, 2014

(65) Prior Publication Data

US 2014/0232800 A1 Aug. 21, 2014

(30) Foreign Application Priority Data

Feb. 18, 2013 (JP) ..... 2013-029008

(51) Int. Cl.
*B65H 5/06* (2006.01)
*B65H 29/12* (2006.01)
(Continued)

(52) U.S. Cl.
CPC ..... *B65H 29/125* (2013.01); *B41J 11/006* (2013.01); *B41J 13/025* (2013.01); *B65H 3/0684* (2013.01); *B65H 5/062* (2013.01); *B65H 29/14* (2013.01); *B65H 31/02* (2013.01); *B65H 31/22* (2013.01); *B65H 2301/4212* (2013.01); *B65H 2402/441* (2013.01); *B65H 2402/46* (2013.01); *B65H 2404/144* (2013.01); *B65H 2404/1441* (2013.01); *B65H 2404/1442* (2013.01); *B65H 2404/152* (2013.01); *B65H 2404/1521* (2013.01); *B65H 2404/6111* (2013.01); *B65H 2405/3322* (2013.01); *B65H 2601/11* (2013.01)

(58) Field of Classification Search
CPC ..... B65H 5/06; B65H 5/062; B65H 5/066; B65H 2601/11; B65H 2404/14; B65H 2404/144–2404/1442
USPC ..... 271/273, 274
See application file for complete search history.

(56) References Cited

U.S. PATENT DOCUMENTS 3,661,383 A * 5/1972 Morrison ..... 271/273
4,558,373 A * 12/1985 Plasencia et al. ..... 358/484
(Continued)

FOREIGN PATENT DOCUMENTS

JP H05-50672 A 3/1993
JP 2003-094740 A 4/2003
JP 2012-091489 A 5/2012

*Primary Examiner* — Jeremy R Severson
(74) *Attorney, Agent, or Firm* — Banner & Witcoff, Ltd.

(57) ABSTRACT

A conveyor device may include first and second conveyor units, and a movable member. The first conveyor unit includes a first roller that contacts an upper surface of a sheet and a second roller that contacts a lower surface of the sheet. The second conveyor unit includes a third roller that contacts the lower surface of the sheet and a fourth roller that contacts the upper surface of the sheet. The first and second rollers and the third and fourth rollers nip and convey the sheet along a conveyance path. When the movable member is located in a first position, the first roller contacts the second roller and the third roller contacts the fourth roller. When the movable member moves to the second position, the first roller is moved away from the second roller and the third roller is moved away from the fourth roller.

20 Claims, 11 Drawing Sheets

(51) Int. Cl.

| | |
|---|---|
| ***B41J 11/00*** | (2006.01) |
| ***B41J 13/02*** | (2006.01) |
| ***B65H 29/14*** | (2006.01) |
| ***B65H 31/02*** | (2006.01) |
| ***B65H 31/22*** | (2006.01) |
| ***B65H 3/06*** | (2006.01) |

(56) References Cited

U.S. PATENT DOCUMENTS

| | | | | |
|---|---|---|---|---|
| 6,005,593 | A * | 12/1999 | Yoshinaga et al. | 346/134 |
| 7,717,423 | B2 * | 5/2010 | Litman et al. | 271/273 |
| 2011/0187040 | A1 * | 8/2011 | Tanahashi et al. | 271/3.18 |
| 2011/0291347 | A1 * | 12/2011 | Sano et al. | 271/3.19 |

* cited by examiner

CONVEYOR DEVICE AND IMAGE RECORDING APPARATUS

CROSS-REFERENCE TO RELATED APPLICATION

This application claims priority from Japanese Patent Application No. 2013-029008, filed on Feb. 18, 2013, which is incorporated herein by reference in its entirety.

FIELD OF DISCLOSURE

The present invention relates to a conveyor device that allows a jam process to be easily performed, and an image recording apparatus.

BACKGROUND

In an image recording apparatus which records an image on a recording sheet, a recording sheet may be jammed on a conveyance path in a state of being held by a conveyor roller pair or a discharge roller pair which conveys a recording sheet. In such a case, it is necessary to remove the recording sheet jammed on the conveyance path (to perform a so-called jam process).

SUMMARY

However, when the jam process is performed, a great force may be required to draw out the recording sheet, or the recording sheet may be torn while being drawn out.

The present invention has been made in view of the circumstances described above, and it is an object of the present invention to provide a conveyor device that allows a jam process to be easily performed, and an image recording apparatus including such a conveyor device.

In at least one aspect, a conveyor device including a first conveyor unit, a second conveyor unit and a movable member. The first conveyor unit including a first roller configured to contact an upper surface of a sheet and to be movable; and a second roller configured to contact a lower surface of the sheet. The first roller and the second roller are configured to nip and convey the sheet along a conveyance path in a conveyance direction. The second conveyor unit disposed along the conveyance path and including a third roller configured to contact the lower surface of the sheet and to be movable; and a fourth roller configured to contact the upper surface of the sheet. The third roller and the fourth roller are configured to nip and convey the sheet in the conveyance direction. The movable member configured to be movable between a first position and a second position. When the movable member is located in the first position, the first roller is in contact with the second roller and the third roller is in contact with the fourth roller, and when the movable member moves to the second position, the first roller is moved away from the second roller while the second roller remains in a static position and the third roller is moved away from the fourth roller while the fourth roller remains in a static position.

According to the present invention, by an operation of moving the movable member from the first position to the second position, a nip of each of the first conveyor roller pair and the second conveyor roller pair may be released and a jammed sheet is inclined in a predetermined direction. Thus, it is possible to easily perform a jam process.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION OF EMBODIMENTS

Figure 1:
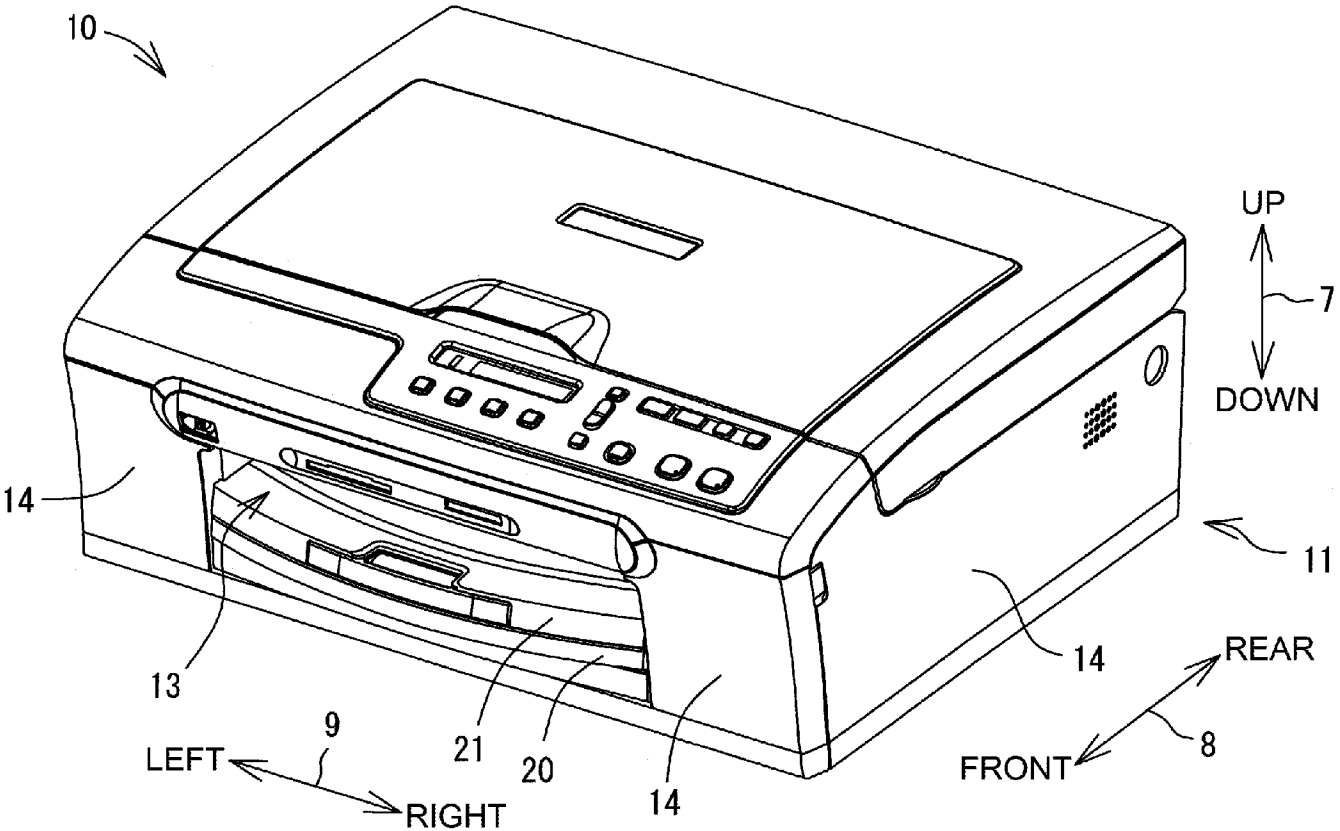
FIG. 1 is a perspective view of a multi-function apparatus which is an example of an embodiment of the present invention.

An illustrative embodiment according to one or more aspects is described below with reference to the accompanying drawings. The illustrative embodiment described below is merely an example. Various changes, arrangements and modifications may be applied therein without departing from the spirit and scope of the disclosure. In the description below, an up-down direction 7 may be defined with reference to an orientation of a multifunction apparatus 10 that may be disposed in which it may be intended to be used (e.g., an orientation depicted in FIG. 1). A side of the multifunction apparatus 10, in which an opening 13 may be defined, may be defined as the front of the multifunction apparatus 10. A front-rear direction 8 may be with reference to the front of the multifunction apparatus 10. A right-left direction 9 may be defined with respect to the multifunction apparatus 10 as viewed from its front.

Overall Structure of Multi-Function Apparatus 10

As shown in FIG. 1, the multi-function apparatus 10 (as an example of an image recording apparatus) may be generally formed in a thin rectangular parallelepiped shape, and a printer unit 11 may be provided in a lower portion thereof. The multi-function apparatus 10 has various functions such as a facsimile function and a print function. As the print function, the multi-function apparatus 10 has a function to record an image on a surface of a recording sheet 12 (see FIG. 2) by ink-jet printing. It should be noted that the multi-function apparatus 10 may record images on both surfaces of a recording sheet 12. The multi-function apparatus 10 may be provided with a conveyor device. The conveyor device may be a device which conveys a recording sheet 12 within the multi-function apparatus 10, and includes a platen 42, a conveyor roller unit, a discharge roller unit, and release rods 70A and 70B, which will be described later.

As shown in FIG. 1, the opening 13 may be formed in a front surface of the printer unit 11. A feed tray 20 may be capable of accommodating recording sheets 12 of various sizes and may be capable of being inserted into or pulled out from the printer unit 11 through the opening 13 in the front-rear direction 8. A discharge tray 21 may be stacked on the feed tray 20. The discharge tray 21 may be moved together with the feed tray 20. The discharge tray 21 may support recording sheets 12 on which images may be recorded by a later-described recording unit 24 and which may be discharged by a later-described discharge roller pair 61.

Figure 2:
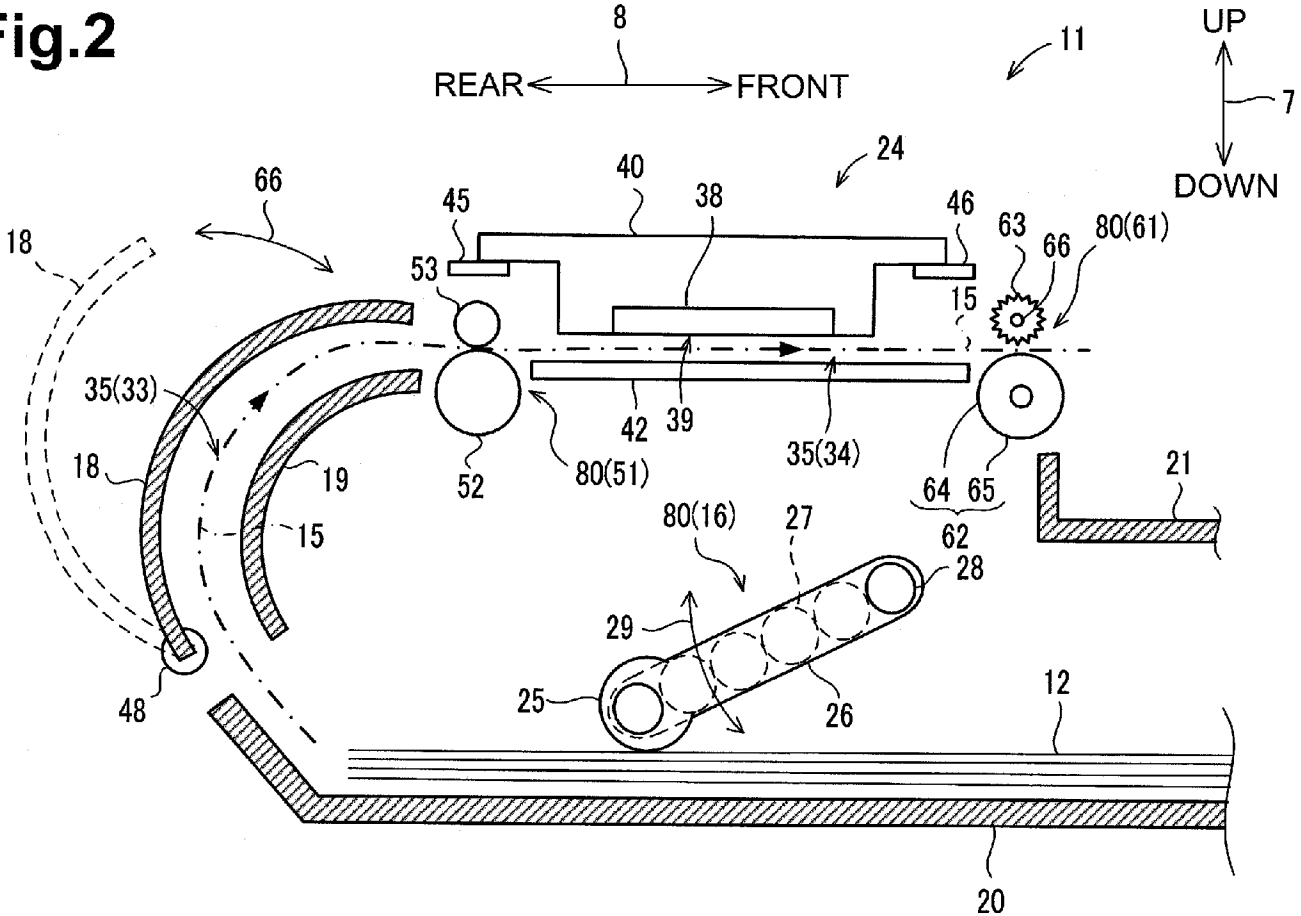
FIG. 2 is a longitudinal cross-sectional view schematically showing an internal structure of a printer unit.

The printer unit 11 may comprise a base member 100 (see FIG. 3), and an outer cover 14 which may cover the base member 100 from above. In addition, as shown in FIG. 2, a feed unit 16, a conveyor roller pair 51, the recording unit 24, a discharge roller pair 61, the platen 42, and the like may be provided within the printer unit 11. The base member 100 may support the feed unit 16, the conveyor roller pair 51, the recording unit 24, the discharge roller pair 61, the platen 42, side frames 120 and 130, and the like, and may be covered with the outer cover 14.

The feed unit 16 may pick up a recording sheet 12 from the feed tray 20 and feed the recording sheet 12 to a conveyance path 35. The conveyor roller pair 51 may convey the recording sheet 12 fed to the conveyance path 35 by the feed unit 16, to a downstream side in a conveyance direction 15. The recording unit 24 records an image by discharging ink drops to the recording sheet 12 conveyed by the conveyor roller pair 51. The discharge roller pair 61 discharges the recording sheet 12 on which the image has been recorded by the recording unit 24, to the discharge tray 21. The platen 42 may support the recording sheet 12 conveyed by the conveyor roller pair 51, from below.

Conveyance Path 35

As shown in FIG. 2, the conveyance path 35 may extend from a rear end of the feed tray 20. The conveyance path 35 may comprise a curved conveyance path 33 and a straight conveyance path 34. The curved conveyance path 33 may extend upward from the rear end of the feed tray 20 and be curved toward the front in the front-rear direction 8. The straight conveyance path 34 may extend along in the front-rear direction 8. The one or more recording sheets 12 supported by the feed tray 20 may be conveyed one by one by the feed unit 16 such that recording sheet 12 may move upward and make a U-turn in the curved conveyance path 33, and then be conveyed on the straight conveyance path 34 ahead in the front-rear direction 8 and guided to the recording unit 24. The recording sheet 12 on which an image has been recorded by the recording unit 24 may be conveyed on the straight conveyance path 34 further ahead in the front-rear direction 8 and discharged to the discharge tray 21. In other words, the recording sheet 12 may be conveyed along the conveyance direction 15 indicated by a dotted-and-dashed line with an arrow in FIG. 2.

The curved conveyance path 33 may be formed by an outer guide member 18 and an inner guide member 19 which face each other at a predetermined interval. The outer guide member 18 forms the curved outer side of the curved conveyance path 33. The inner guide member 19 forms the curved inner side of the curved conveyance path 33. The straight conveyance path 34 may be formed at a position where the recording unit 24 is arranged, and by the recording unit 24 and the platen 42 which face each other at a predetermined interval. In other words, each of the guide members 18 and 19 forms at least a part of the conveyance path 35.

The outer guide member 18 may be rotatably supported by the later-described base member 100. Shafts 48 may be formed at both ends, in the left-right direction 9, of a lower portion of the outer guide member 18 and may extend in the left-right direction 9. In the embodiment, the shafts 48 are projections which may project from both ends of the outer guide member 18 outwardly in the left-right direction 9. The shafts 48 may be inserted into holes (not shown) formed in the base member 100. Thus, the outer guide member 18 rotates between a cover position where the outer guide member 18 may cover the curved conveyance path 33 (a position indicated by a solid line in FIG. 2) and an exposure position where the outer guide member 18 exposes the curved conveyance path 33 (a position indicated by a dotted line in FIG. 2).

The outer guide member 18 at the cover position, together with the inner guide member 19 facing the outer guide member 18, forms the curved conveyance path 33 of the conveyance path 35. Meanwhile, when the outer guide member 18 may be located at the exposure position, the outer surface of the inner guide member 19 may be exposed to the outside of the printer unit 11. In other words, the outer guide member 18 at the exposure position exposes the curved conveyance path 33 of the conveyance path 35 to the outside. Thus, a user of the multi-function apparatus 10 may be allowed to take out a recording sheet 12 jammed on the curved conveyance path 33 (to perform a so-called jam process).

Conveyor Unit 80

A conveyor unit 80 includes the feed unit 16 arranged on the upstream side, in the conveyance direction 15, of the curved conveyance path 33, the conveyor roller pair 51 arranged on the upstream side, in the conveyance direction 15, of the recording unit 24 on the straight conveyance path 34, and the discharge roller pair 61 arranged on the downstream side in the conveyance direction 15, of the recording unit 24 on the straight conveyance path 34. It should be noted that the conveyor roller unit (as an example of a first conveyor unit) includes the conveyor roller pair 51, later-described bearings 54 and 55, later-described roller holders 56, a later-described release shaft 57, and later-described coil springs 58. In addition, the discharge roller unit (as an example of a second conveyor unit) includes the discharge roller pair 61, a later-described coil spring 67, and a later-described support plate 68.

Feed Unit 16

As shown in FIG. 2, the feed unit 16 may be provided within the printer unit 11, above the feed tray 20, and below the recording unit 24. The feed unit 16 includes a feed roller 25, a feed arm 26, and a drive transmission mechanism 27. The feed roller 25 is rotatably supported by an end portion of the feed arm 26. The feed arm 26 rotates in the direction of an arrow 29 about a shaft 28 provided at a base end portion thereof. Thus, the feed roller 25 may be able to come into contact with and move away from the feed tray 20 or a recording sheet 12 supported by the feed tray 20. The feed roller 25 may be rotated by a driving force of a conveyor motor (not shown) being transmitted thereto by the drive transmission mechanism 27 including a plurality of intermeshing gears. It should be noted that the feed roller 25 may be rotated by a driving force being applied thereto from a motor provided independently of the conveyor motor.

Conveyor Roller Pair 51

As shown in FIG. 2, the conveyor roller pair 51 includes a conveyor roller 52 (as an example of a second roller) and pinch rollers 53 (as an example of a first roller and a driven roller). The conveyor roller 52 in the embodiment may be formed, for example, by applying a ceramic coating onto the outer circumferential surface of a roller shaft. In addition, in the embodiment, a metallic cylindrical shaft (hollow shaft) may be used as the roller shaft. It should be noted that the specific configuration of the conveyor roller 52 might be not limited thereto, and a roller may be fitted on a roller shaft, or a solid shaft may be used as the roller shaft.

The conveyor roller 52 in the embodiment may be arranged on the lower side of the straight conveyance path 34 and may come into contact with a lower surface (as an example of a second surface) of a recording sheet 12 guided from the curved conveyance path 33 to the straight conveyance path 34. The conveyor roller 52 may be rotated by a driving force being applied thereto from a conveyor motor which may be capable of being rotationally driven in a forward direction and in a reverse direction. Meanwhile, the pinch rollers 53 may be arranged on the upper side of the straight conveyance path 34 so as to may face the conveyor roller 52 and may come into contact with an upper surface (as an example of a first surface) of the recording sheet 12. The pinch rollers 53 rotate in a following manner with rotation of the conveyor roller 52. The conveyor roller 52 and the pinch rollers 53 cooperate to hold the recording sheet 12 therebetween in the up-down direction 7 and convey the recording sheet 12 in the conveyance direction 15.

The conveyor roller 52 may be rotated in a forward direction by a driving force being applied thereto from the conveyor motor that may be rotationally driven in the forward direction. Here, the rotation of the conveyor roller 52 in the forward direction is rotation in such a direction that a recording sheet 12 may be conveyed in the conveyance direction 15. In other words, the rotation of the conveyor roller 52 in the forward direction when the printer unit 11 may be seen from the direction of FIG. 2 is clockwise rotation, and the rotation of the pinch rollers 53 in a forward direction is counter clockwise rotation. Meanwhile, the conveyor roller 52 may be rotated in a reverse direction by a driving force being applied from the conveyor motor that may be rotationally driven in the reverse direction. The rotation of the conveyor roller 52 in the reverse direction is rotation in such a direction that a recording sheet 12 may be conveyed in a direction opposite to the conveyance direction 15. In other words, the rotation of the conveyor roller 52 in the reverse direction as seen from the direction of FIG. 2 is counter clockwise rotation, and rotation of the pinch rollers 53 in a reverse direction is clockwise rotation.

Discharge Roller Pair 61

As shown in FIG. 2, the discharge roller pair 61 includes a discharge roller 62 (as an example of a third roller) and spurs 63 (as an example of a fourth roller). The discharge roller 62 in the embodiment may be arranged on the lower side of the straight conveyance path 34 and may come into contact with a lower surface of a recording sheet 12 conveyed on the straight conveyance path 34. The discharge roller 62 includes a shaft 64 which may be rotated by a driving force being applied from the conveyor motor, and rollers 65 which may be fitted on the shaft 64 and rotated together with the shaft 64. Meanwhile, the spurs 63 may be arranged on the upper side of the straight conveyance path 34 so as to face the discharge roller 62 and come into contact with an upper surface of the recording sheet 12. The spurs 63 may be fitted on a shaft 66 and rotated in a following manner with rotation of the discharge roller 62. The discharge roller 62 and the spurs 63 cooperate to hold the recording sheet 12 therebetween in the up-down direction 7 and convey the recording sheet 12 in the conveyance direction 15. As a result, the recording sheet 12 may be conveyed to the opening 13 located on the downstream side, in the conveyance direction 15, of the discharge roller pair 61 and discharged to the discharge tray 21 inserted into a later-described tray accommodation space 107.

The discharge roller 62 may be rotated in a forward direction by a driving force being applied thereto from the conveyor motor that may be rotationally driven in the forward direction. Here, rotation of the discharge roller 62 in the forward direction is rotation in such a direction that a recording sheet 12 may be conveyed in the conveyance direction 15. In other words, the rotation of the discharge roller 62 in the forward direction as seen from the direction of FIG. 2 is clockwise rotation, and rotation of the spurs 63 in a forward direction is counter clockwise rotation. Meanwhile, the discharge roller 62 may be rotated in a reverse direction by a driving force being applied thereto from the conveyor motor that may be rotationally driven in the reverse direction. The rotation of the discharge roller 62 in the reverse direction is rotation in such a direction that a recording sheet 12 may be conveyed in a direction opposite to the conveyance direction 15. In other words, the rotation of the discharge roller 62 in the reverse direction as seen from the direction of FIG. 2 is counter clockwise rotation, and rotation of the spurs 63 in a reverse direction is clockwise rotation.

Platen 42

As shown in FIG. 2, the platen 42 may be provided on the lower side of the straight conveyance path 34 at a position between the conveyor roller pair 51 and the discharge roller pair 61, namely, on the downstream side, in the conveyance direction 15, of the conveyor roller pair 51 and on the upstream side, in the conveyance direction 15, of the discharge roller pair 61. The platen 42 is a member which may be arranged so as to face the recording unit 24 in the up-down direction 7 and support a recording sheet 12 conveyed on the straight conveyance path 34, from below.

Recording Unit 24

As shown in FIG. 2, the recording unit 24 may be arranged on the upper side of the straight conveyance path 34 and at such a position as to face the platen 42 in the up-down direction 7. The recording unit 24 includes a carriage 40 and a recording head 38. The carriage 40 may be supported by two guide rails 45 and 46. The two guide rails 45 and 46 may be arranged so as to be spaced apart from each other in the front-rear direction 8 and may extend in the left-right direction 9. The carriage 40 may be arranged so as to extend over the guide rails 45 and 46 and reciprocate along the two guide rails 45 and 46 in the left-right direction 9 which is a main scanning direction. The recording head 38 may be mounted in the carriage 40. The recording head 38 discharges ink supplied from ink cartridges (not shown), through nozzles 39 provided on a lower surface thereof. In other words, while the carriage 40 moves in the left-right direction 9, ink drops may be discharged through the nozzles 39 of the recording head 38 to the platen 42, whereby an image may be recorded on an upper surface of a recording sheet 12 supported by the platen 42.

Base Member 100

Figure 3:
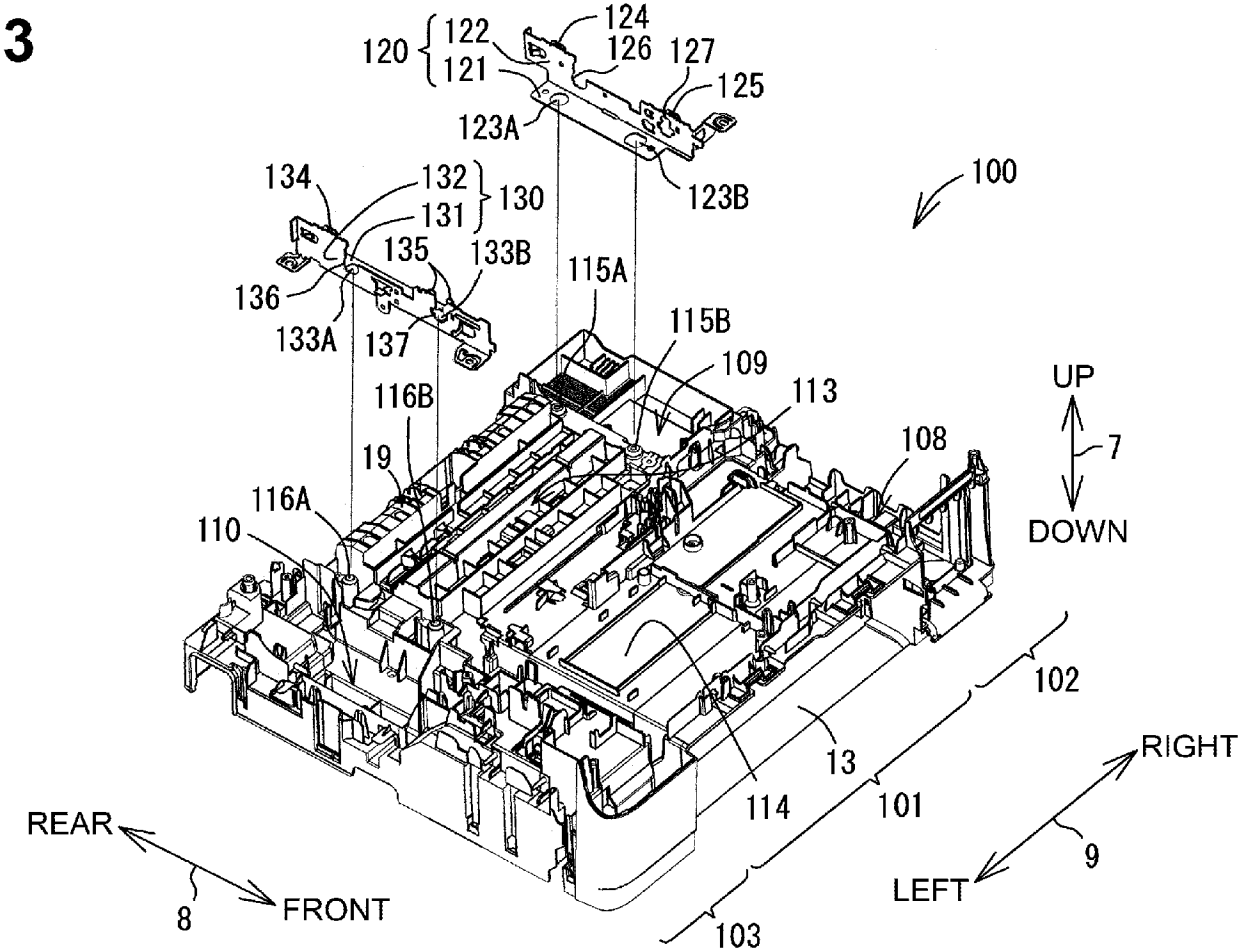
FIG. 3 is an exploded perspective view of a base member and side frames.

As shown in FIG. 3, the base member 100 includes a center base 101 located at a central portion thereof in the left-right direction 9, and side bases 102 and 103 adjacent to the center base 101 in the left-right direction 9. The side base 102 may be provided adjacently on the right side of the center base 101. The side base 103 may be provided adjacently on the left side of the center base 101. In other words, the side bases 102 and 103 may be provided at such positions as to be spaced apart from each other in the left-right direction 9. In addition, the center base 101 may be located between the side bases 102 and 103 in the left-right direction 9. It should be noted that the base member 100 in the embodiment may be integrally formed from a resin material.

The center base 101 includes a main wall 113 located on the rear side in the front-rear direction 8, and a main wall 114 located on the front side in the front-rear direction 8. The main walls 113 and 114 may be provided between the side bases 102 and 103 so as to extend in the front-rear direction 8 and the left-right direction 9. Meanwhile, the main walls 113 and 114 may be spaced apart from each other in the front-rear direction 8. The main wall 113 may support the feed unit 16, the recording unit 24, the conveyor roller pair 51, the discharge roller pair 61, the platen 42, and the like. The main wall 114 may support a control substrate (not shown) which controls operation of the multi-function apparatus 10, and the like.

Figure 5:
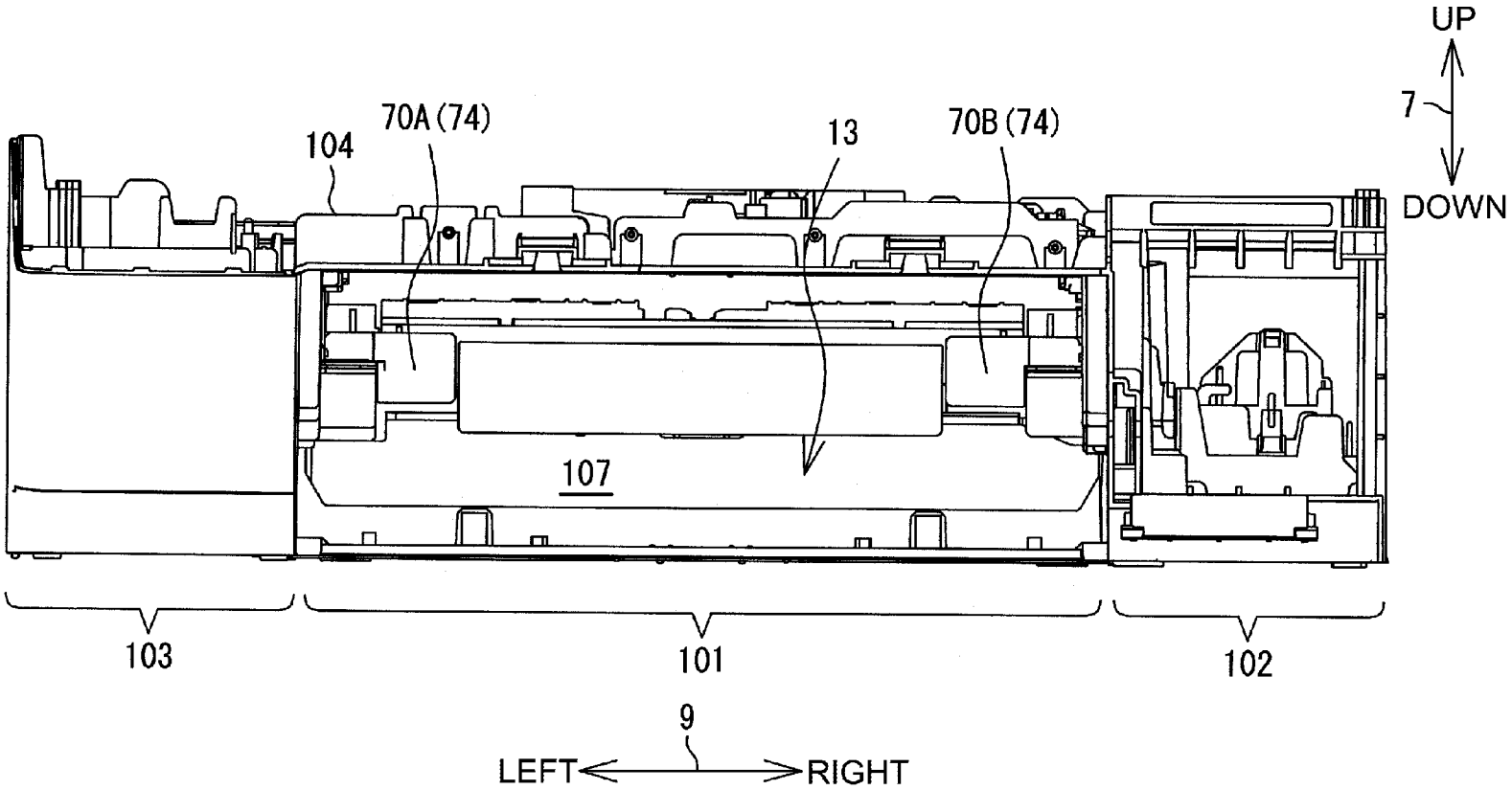
FIG. 5 is a plan view of the multi-function apparatus as seen from the front.

The tray accommodation space 107 (see FIG. 5) may be provided in the center base 101 and accommodates the feed tray 20 and the discharge tray 21 therein. As shown in FIG. 5, the tray accommodation space 107 may be formed below the main walls 113 and 114 of the center base 101 in the up-down direction 7. In addition, the tray accommodation space 107 may be provided in substantially the entire area of the base member 100 in the front-rear direction 8. Furthermore, the tray accommodation space 107 may be provided at a position corresponding to the center base 101 in the left-right direction 9 (namely, at a central portion of the base member 100).

As shown in FIG. 3, projections 115A, 115B, 116A, and 116B may be provided at both end portions, in the left-right direction 9, of an upper surface of the main wall 113. The projections 115A and 115B may be provided at the right end of the upper surface of the main wall 113 so as to be spaced apart from each other in the front-rear direction 8. The projections 116A and 116B may be provided at the left end of the upper surface of the main wall 113 so as to be spaced apart from each other in the front-rear direction 8. In addition, a screw hole into which a screw (as an example of a fastening member) may be screwed may be formed at substantially a center of the projections 115A, 115B, 116A, and 116B.

The inner guide member 19 may be provided at an end portion of the main wall 113 on the rear side in the front-rear direction 8 (namely, at an end portion thereof on the upstream side in the conveyance direction 15). A recording sheet 12 supported by the feed tray 20 may be guided from the lower surface of the main wall 113 to the upper surface side of the main wall 113 by the inner guide member 19. Furthermore, the recording sheet 12 may be guided to the front side in the front-rear direction 8 along the upper surface of the main wall 113 and the lower surface of the main wall 114. In other words, the curved conveyance path 33 may be curved from the lower surface side to the upper surface side of the main wall 113 along an end portion of the main wall 113 on the rear side. In addition, the straight conveyance path 34 may be provided linearly in the front-rear direction 8 on a horizontal plane along the upper surface of the main wall 113 and the lower surface of the main wall 114.

As shown in FIG. 3, a pair of the side frames 120 and 130 may be mounted on the upper surface of the main wall 113 at positions spaced apart from each other in the left-right direction 9. The side frames 120 and 130 may be formed by conducting sheet metal working on metal. The side frame 120 may be formed by combining a plate-shape base portion 121 and a support wall 122 such that a cross-sectional shape in a transverse direction is an L shape. The side frame 130 may be formed by combining a plate-shape base portion 131 and a support wall 132 such that a cross-sectional shape in a transverse direction is an L shape.

The base portion 121 may be mounted on the upper surface of the main wall 113 such that its longitudinal direction may be directed in the front-rear direction 8. Through holes 123A and 123B may be provided in the base portion 121 at positions spaced apart from each other in the front-rear direction 8. When the side frame 120 is mounted on the main wall 113, the projections 115A and 115B may be inserted into the through holes 123A and 123B. In other words, the projections 115A and 115B and the through holes 123A and 123B may be provided at positions corresponding to each other, and position the side frame 120 with respect to the main wall 113 in the front-rear direction 8 and the left-right direction 9. By screwing screws into screw holes in the projections 115A and 115B in a state where the side frame 120 may be mounted on the main wall 113, the side frame 120 may be fixed to the main wall 113.

The support wall 122 may project from an end portion of the base portion 121 on one side in the transverse direction. In other words, in a state where the side frame 120 may be mounted on the main wall 113, the support wall 122 may project upwardly and may extend in the front-rear direction 8. In the support wall 122, protrusion pieces 124 and 125 protruding further upwardly from an upper end thereof and a first receiving portion 126 and a second receiving portion 127 extending therethrough in the thickness direction thereof may be provided so as to be spaced apart from each other in the longitudinal direction of the side frame 120. In a state where the side frame 120 is mounted on the main wall 113, the protrusion piece 124, the first receiving portion 126, the second receiving portion 127, and the protrusion piece 125 may be provided in the support wall 122 in order from the rear side to the front side in the front-rear direction 8.

The configuration of the side frame 130 is the same as that of the side frame 120. In other words, through holes 133A and 133B may be provided in the base portion 131. In addition, protrusion pieces 134 and 135, a first receiving portion 136, and a second receiving portion 137 may be provided in the support wall 132. As a result, in a state where the side frames 120 and 130 may be mounted on the main wall 113, the support walls 122 and 132 may face each other in the left-right direction 9. More specifically, in the front-rear direction 8, the protrusion pieces 124 and 134 may face each other, the protrusion pieces 125 and 135 may face each other, the first receiving portions 126 and 136 may face each other, and the second receiving portions 127 and 137 may face each other.

Figure 4:
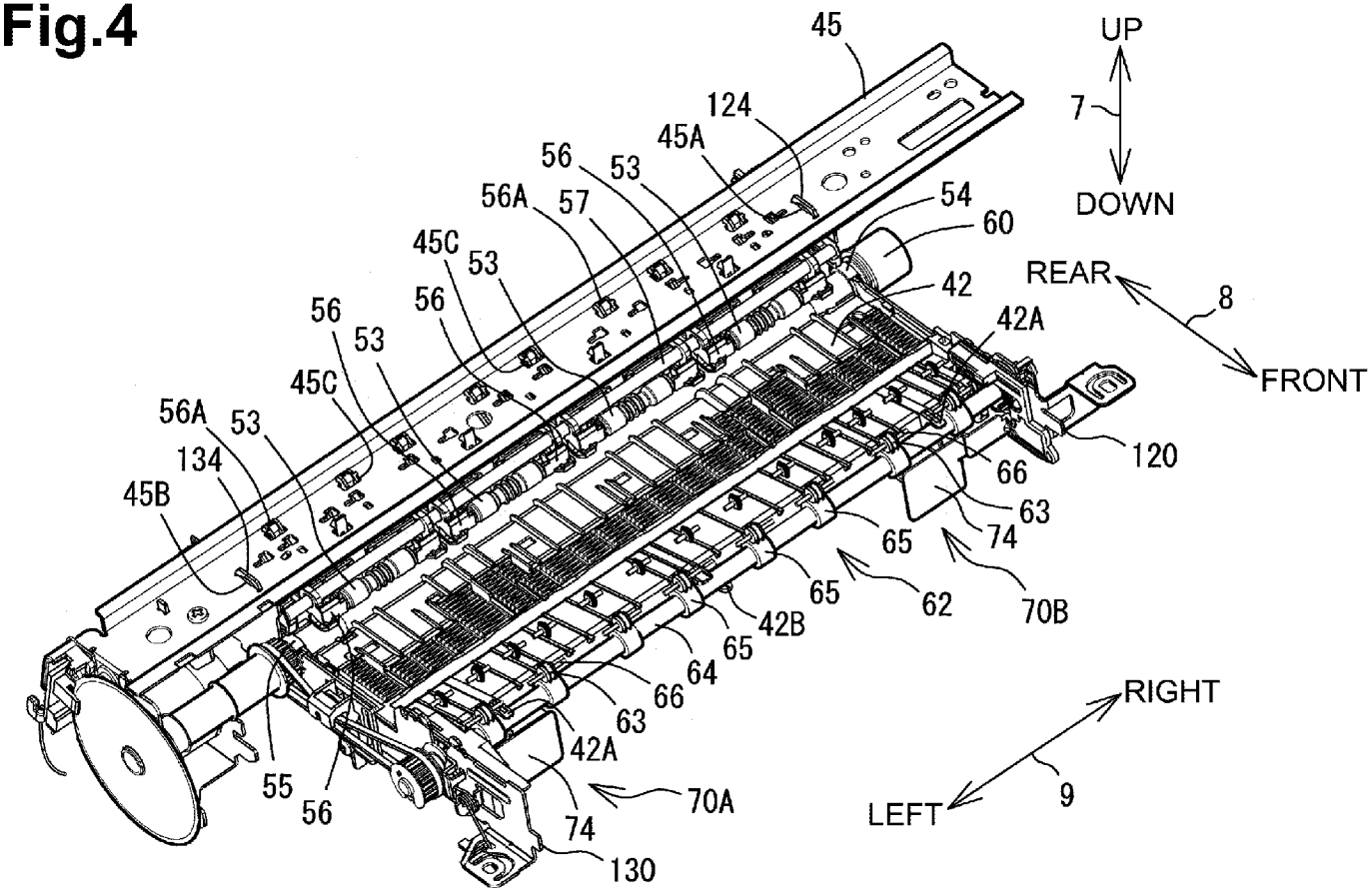
FIG. 4 is a perspective view of a guide rail supported by the side frames, a conveyor roller pair, a platen, a discharge roller pair, release rods, and the side frames.

As shown in FIG. 4, the guide rail 45 may be supported by the side frames 120 and 130. Specifically, through holes 45A and 45B may be provided in the guide rail 45 at positions spaced apart from each other in the left-right direction 9, so as to extend therethrough in the thickness direction thereof (in the up-down direction 7 in FIG. 4). The through holes 45A and 45B may be located at positions corresponding to the protrusion pieces 124 and 134 of the side frames 120 and 130 and may be shaped so as to correspond to the protrusion pieces 124 and 134. In other words, when the guide rail 45 may be supported by the upper ends of the side frames 120 and 130, the protrusion pieces 124 and 134 may be inserted into the through holes 45A and 45B. Thus, the guide rail 45 may be positioned with respect to the side frames 120 and 130 (namely, the base member 100) in the front-rear direction 8 and the left-right direction 9.

In addition, although not shown, similarly to the guide rail 45, the guide rail 46 may be supported by the upper ends of the side frames 120 and 130 and positioned in the front-rear direction 8 and the left-right direction 9 by the protrusion pieces 125 and 135. In other words, the guide rails 45 and 46 may be supported by the side frames 120 and 130 at positions spaced apart from each other in the front-rear direction 8 and may extend in the left-right direction 9.

As shown in FIG. 4, the bearings 54 and 55 may be fitted on the conveyor roller 52 at positions spaced apart from each other in the axial direction thereof (in the left-right direction 9 in FIG. 4). Specifically, the bearings 54 and 55 may be fitted on the conveyor roller 52 at positions corresponding to the first receiving portions 126 and 136 of the side frames 120 and 130. The bearing 54 may be supported by the first receiving portion 126 of the side frame 120, and the bearing 55 may be supported by the first receiving portion 136 of the side frame 130.

The conveyor roller pair 51 includes a plurality of (four in the embodiment) pinch rollers 53 provided so as to be spaced apart from each other in the axial direction of the conveyor roller 52. The respective pinch rollers 53 may be rotatably supported by a plurality of (four in the embodiment) roller holders 56. Each roller holder 56 includes an engagement portion 56A. The engagement portion 56A may pass through a through hole 45C extending through the guide rail 45 in the thickness direction thereof and may be engaged with the upper surface of the guide rail 45. In other words, each roller holder 56 may be supported by the guide rail 45.

In addition, the coil spring 58 (as an example of an urging member, see FIG. 9B) may be provided between the guide rail 45 and each roller holder 56 and urge each roller holder 56 (namely, each pinch roller 53) in a direction in which each roller holder 56 can be pressed against the conveyor roller 52. The coil spring 58 urges each roller holder 56 in a direction in which each pinch roller 53 can be pressed against the conveyor roller 52 (namely, downwardly). In other words, the coil spring 58 urges each pinch roller 53 downwardly.

Furthermore, the release shaft 57 may be inserted through a hole 56C (see FIG. 9B) provided in each roller holder 56. The release shaft 57 may extend along the axis of the conveyor roller 52 and may be configured to be moveable in a radial direction. In addition, the release shaft 57 may be arranged at a position different from that of each pinch roller 53 in the front-rear direction 8. Specifically, the release shaft 57 may be located on the upstream side, in the conveyance direction 15, of the pinch rollers 53. In other words, the pinch rollers 53 may be located on the downstream side, in the conveyance direction 15, of the release shaft 57. When being moved upwardly, the release shaft 57 may come into contact with a wall surface of each roller holder 56 defining the hole 56C and move each roller holder 56 upwardly against the urging force of the coil spring 58. In other words, each pinch roller 53 may be configured to be moveable in the radial direction.

The discharge roller 62 includes the shaft 64 and a plurality of the rollers 65 fitted on the shaft 64 at positions spaced apart from each other in the axial direction. The shaft 64 may be rotatably supported by the side frames 120 and 130 via bearings (not shown) fitted thereon at positions spaced apart from each other in the axial direction. More specifically, the bearings fitted on the shaft 64 may be supported by the second receiving portions 127 and 137 of the side frames 120 and 130. In addition, the shaft 64 may be urged upwardly by the coil spring 67 (as an example of an urging member, see FIG. 9A). In other words, the discharge roller 62 may be configured to be moveable in the radial direction. The spurs 63 may be provided at a plurality of positions on the discharge roller 62 corresponding to the respective rollers 65. The spurs 63 may be rotatably supported by the shaft 66. A plurality of the spurs 63 may be supported by the support plate 68 (see FIGS. 9A and 9B). The support plate 68 may be supported by the guide rail 46.

As described above, the guide rails 45 and 46, the conveyor roller pair 51, and the discharge roller pair 61 may be supported by the side frames 120 and 130. In addition, the carriage 40 (namely, the recording unit 24) may be supported by the side frames 120 and 130 via the guide rails 45 and 46. In other words, the guide rails 45 and 46, the conveyor roller pair 51, the recording unit 24, and the discharge roller pair 61 may be supported by the main wall 113 of the base member 100 via the side frames 120 and 130. Meanwhile, the feed unit 16 may be supported directly by the main wall 113.

Engagement portions 42A and 42B may be provided at an end portion of the platen 42 on the front side (namely, on the downstream side in the conveyance direction 15). The engagement portions 42A and 42B may be provided so as to be spaced apart from each other in the longitudinal direction of the platen 42 (namely, in the left-right direction 9). More specifically, the engagement portions 42A may protrude frontward from both ends, in the longitudinal direction, of the platen 42. Meanwhile, the engagement portion 42B may protrude frontward from the center, in the longitudinal direction, of the platen 42. The engagement portions 42A are in contact with the outer surface of the shaft 64 of the discharge roller 62 from above. The engagement portion 42B is in contact with the outer surface of the shaft 64 of the discharge roller 62 from below. That is, the engagement portions 42A and 42B hold the shaft 64 of the discharge roller 62 in the up-down direction 7. In other words, the platen 42 may be supported by the shaft 64 of the discharge roller 62.

Figure 9A:
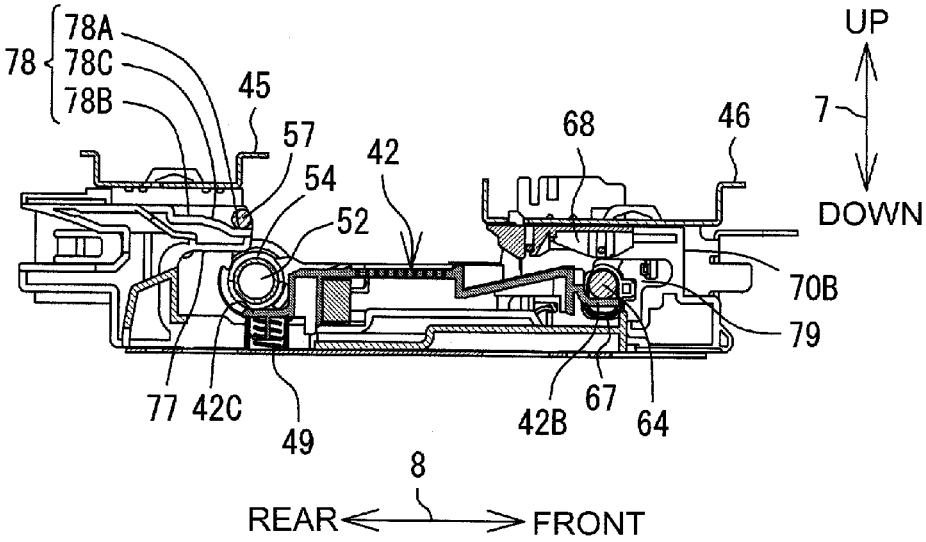
FIGS. 9A and 9B are cross-sectional views showing a state of the conveyor roller pair, the discharge roller pair, and the platen when the release rod is located at the first position.

Protrusion pieces 42C may be provided at an end portion of the platen 42 on the rear side (namely, on the upstream side in the conveyance direction 15) so as to protrude rearward as shown in FIG. 9A. More specifically, the protrusion pieces 42C may protrude rearward from both ends, in the longitudinal direction, of the platen 42. The protrusion pieces 42C are in contact at the upper surfaces thereof with the outer surfaces of the bearings 54 and 55 on the conveyor roller 52 and receive, at the lower surfaces thereof, urging forces from coil springs 49. In other words, the protrusion pieces 42C may be urged upwardly by the coil springs 49 in a state where upward movement thereof may be restricted by the bearings 54 and 55.

In addition, the release rods 70A and 70B (as an example of a movable member) may be provided along the side frames 120 and 130. Specifically, the release rod 70A may be provided on the upper surface of the base portion 131 of the side frame 130 so as to extend along the right surface of the support wall 132 of the side frame 130 in the front-rear direction 8. The release rod 70B may be provided on the upper surface of the base portion 121 of the side frame 120 so as to extend along the left surface of the support wall 122 of the side frame 120 in the front-rear direction 8. The release rods 70A and 70B may be configured to be moveable along the side frames 120 and 130 in the front-rear direction 8.

Figure 6B:
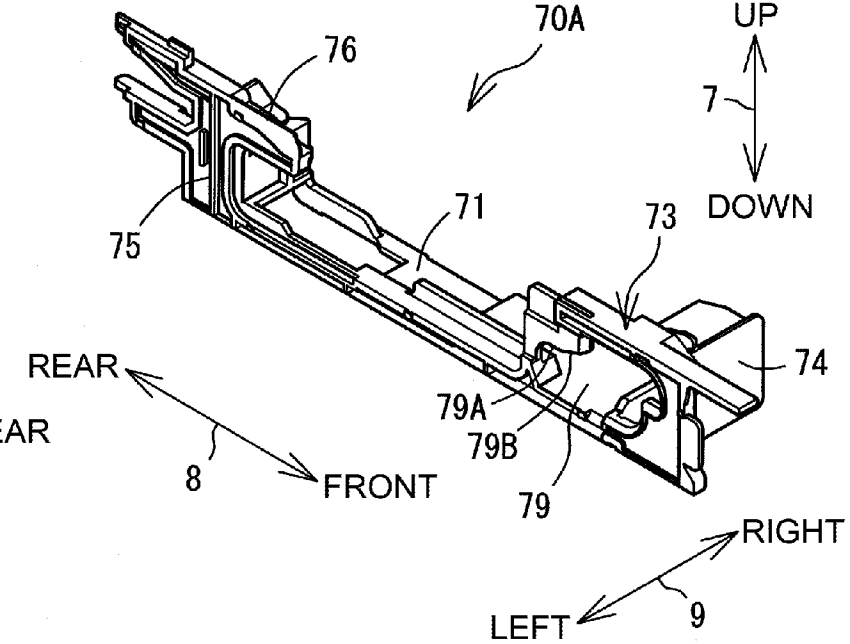
FIGS. 6A and 6B are perspective views of the release rod.
Figure 6A:
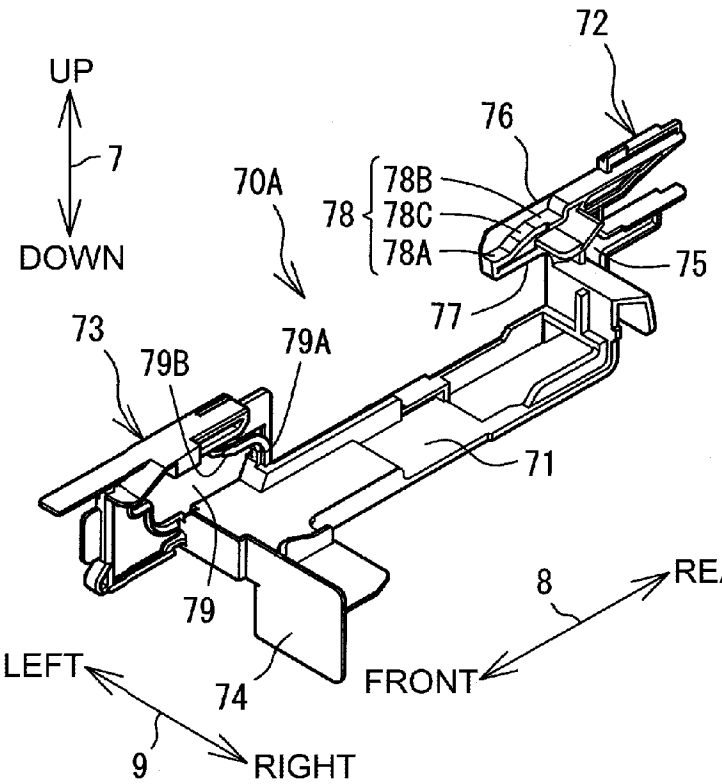

As shown in FIGS. 6A and 6B, the release rod 70A includes a base portion 71, a conveyor roller contact portion 72 (as an example of a first contact portion), a discharge roller contact portion 73 (as an example of a second contact portion), and a grip portion 74 (as an example of a projecting portion). It should be noted that the release rods 70A and 70B may have the same configuration except that positions at which the conveyor roller contact portion 72, the discharge roller contact portion 73, and the grip portion 74 may be mounted on the base portion 71 are opposite, and thus the release rod 70A will be described below. In addition, each portion of the release rod 70A will be described below using directions (the up-down direction 7, the front-rear direction 8, and the left-right direction 9) in a state where the release rod 70A may be mounted on the multi-function apparatus 10.

The base portion 71 is a plate-shaped member extending in the front-rear direction 8 and the left-right direction 9. The base portion 71 is a long member which may be longer in the front-rear direction 8 than in the left-right direction 9, and may be arranged substantially parallel to the base portion 131 of the side frame 130. In other words, when the release rod 70A moves in the front-rear direction 8, the base portion 71 moves along the upper surface of the base portion 131 of the side frame 130.

The conveyor roller contact portion 72 is a plate-shaped member extending in the up-down direction 7 and the front-rear direction 8. The conveyor roller contact portion 72 may be provided upright at one end, in the longitudinal, direction of the base portion 71 (namely, at a rear end thereof in the front-rear direction 8) and at one end, in the transverse direction, of the base portion 71 (namely, at a left end thereof in the left-right direction 9) so as to extend in the thickness direction of the base portion 71 (namely, upwardly in the up-down direction 7). In other words, the base portion 71 and the conveyor roller contact portion 72 extend in such directions as to intersect each other.

The conveyor roller contact portion 72 includes a base portion 75 protruding upwardly from the base portion 71; and an end portion 76 protruding frontward from an upper end of the base portion 75. In addition, the end portion 76 includes a bearing contact portion 77 in contact with the outer surface of the bearing 55 supporting the shaft of the conveyor roller 52; and a shaft contact portion 78 in contact with the outer surface of the release shaft 57. The bearing contact portion 77 and the shaft contact portion 78 may be provided on the opposite sides, in the up-down direction 7, of the end portion 76. More specifically, the bearing contact portion 77 may be provided on the lower side of the end portion 76, and the shaft contact portion 78 may be provided on the upper side of the end portion 76.

The upper surface of the shaft contact portion 78 may be composed of a first surface 78A, a second surface 78B, and an inclined surface 78C. The first surface 78A and the second surface 78B may be provided so as to be spaced apart from each other in the up-down direction 7 and the front-rear direction 8 and so as to extend substantially along a horizontal plane. Specifically, the first surface 78A may be located in front of and below the second surface 78B. In other words, the second surface 78B may be located in the rear of and above the first surface 78A. As a result, the second surface 78B is farther from the bearing contact portion 77 than the first surface 78A in the up-down direction 7. The inclined surface 78C connect a rear end of the first surface 78A and a front end of the second surface 78B to each other. The inclined surface 78C may be inclined upwardly from the first surface 78A side to the second surface 78B side (namely, toward the rear side).

The discharge roller contact portion 73 is a plate-shaped member extending in the up-down direction 7 and the front-rear direction 8. The discharge roller contact portion 73 may be provided upright at another end, in the longitudinal direction, of the base portion 71 (namely, at a front end thereof in the front-rear direction 8) and at one end, in the transverse direction, of the base portion 71 (namely, at the left end thereof in the left-right direction 9) so as to extend in the thickness direction of the base portion 71 (namely, upwardly in the up-down direction 7). In other words, the base portion 71 and the discharge roller contact portion 73 extend in such directions as to intersect each other. In addition, the conveyor roller contact portion 72 and the discharge roller contact portion 73 may be provided substantially parallel to each other (more specifically, substantially on the same plane).

The discharge roller contact portion 73 may be provided with a through hole 79 extending therethrough in the thickness direction thereof (namely, in the left-right direction 9). The shaft 64 of the discharge roller 62 may be inserted through the through hole 79. In addition, a wall surface defining an upper edge of the through hole 79 includes a retaining surface 79A and a guide surface 79B. The retaining surface 79A may be located at a front end of the upper edge of the through hole 79 and is substantially horizontal (or its rear side is located slightly above its front side). The guide surface 79B may be connected to a front end of the retaining surface 79A and inclined such that its rear side may be located below its front side.

The grip portion 74 is a plate-shaped member extending in the up-down direction 7 and the left-right direction 9. The grip portion 74 may be provided at the other end, in the longitudinal direction, of the base portion 71 (namely, at the front end thereof in the front-rear direction 8) and at another end, in the transverse direction, of the base portion 71 (namely, at a right end thereof in the left-right direction 9) so as to project rightward. In other words, the grip portion 74 may extend in such a direction as to intersect the base portion 71, the conveyor roller contact portion 72, and the discharge roller contact portion 73. In addition, as shown in FIG. 5, the grip portion 74 may be exposed to the tray accommodation space 107.

In other words, the user is able to hold the grip portion 74 through the opening 13 by drawing out the feed tray 20 and the discharge tray 21 from the tray accommodation space 107. More specifically, the user is able to draw out the release rod 70A frontward or push the release rod 70A rearward by inserting a hand into the tray accommodation space 107 through the opening 13 and holding the grip portion 74. In addition, when the feed tray 20 and the discharge tray 21 are inserted into the tray accommodation space 107 in a state where the release rod 70A is drawn out, the rear end of the feed tray 20 or the discharge tray 21 and the grip portion 74 may come into contact with each other, whereby the release rod 70A may be pushed rearward.

Figure 7:
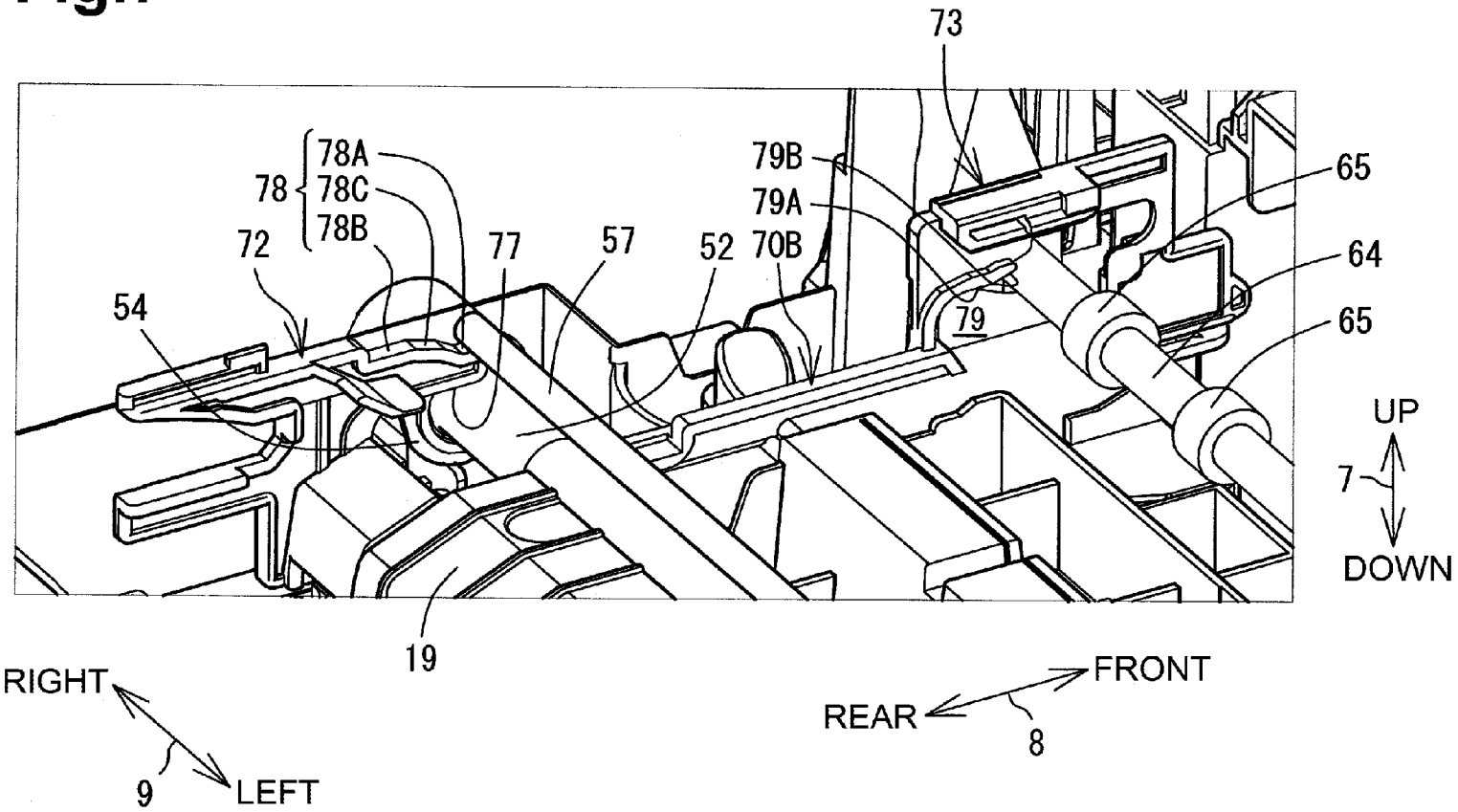
FIG. 7 is a partial perspective view showing a state of the conveyor roller pair and the discharge roller pair when the release rod is located at a first position.
Figure 8:
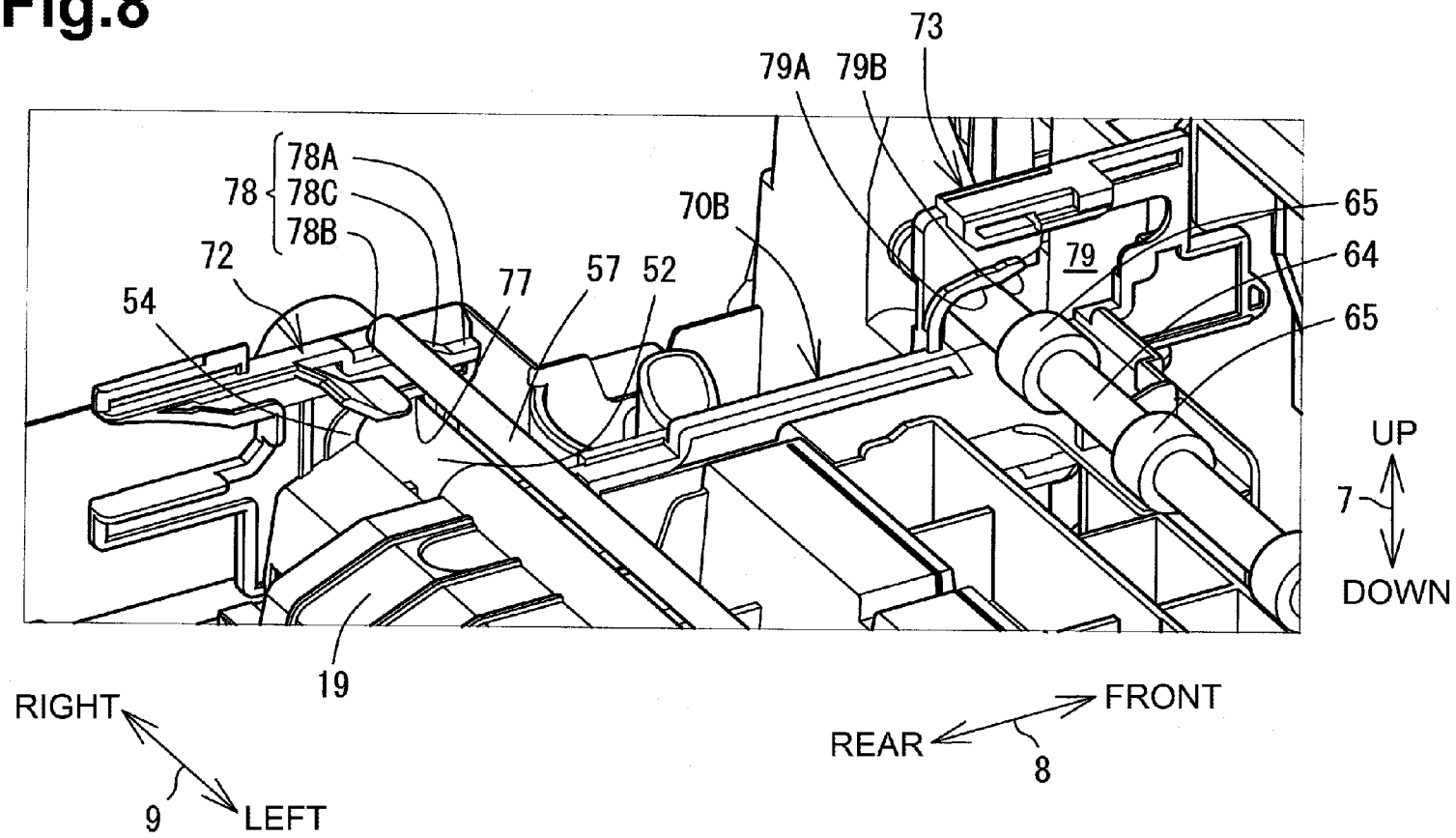
FIG. 8 is a partial perspective view showing a state of the conveyor roller pair and the discharge roller pair when the release rod is located at a second position.

Thus, the release rods 70A and 70B are moveable in the front-rear direction 8 between a first position shown in FIG. 7 (namely, a position to which the release rods 70A and 70B may be pushed rearward) and a second position shown in FIG. 8 (namely, a position to which the release rods 70A and 70B may be drawn out frontward). It should be noted that when the release rods 70A and 70B are located at the first position, the conveyor roller 52 and the pinch rollers 53 are in contact with each other, and the rollers 65 of the discharge roller 62 and the spurs 63 are in contact with each other. Meanwhile, when the release rods 70A and 70B are located at the second position, the conveyor roller 52 and the pinch rollers 53 may be spaced apart from each other, and the rollers 65 of the discharge roller 62 and the spurs 63 may be spaced apart from each other. It should be noted that FIGS. 7 to 10B, which may be referred to in the following description, show only the release rod 70B, but the release rod 70A is also in the same state.

Figure 9B:
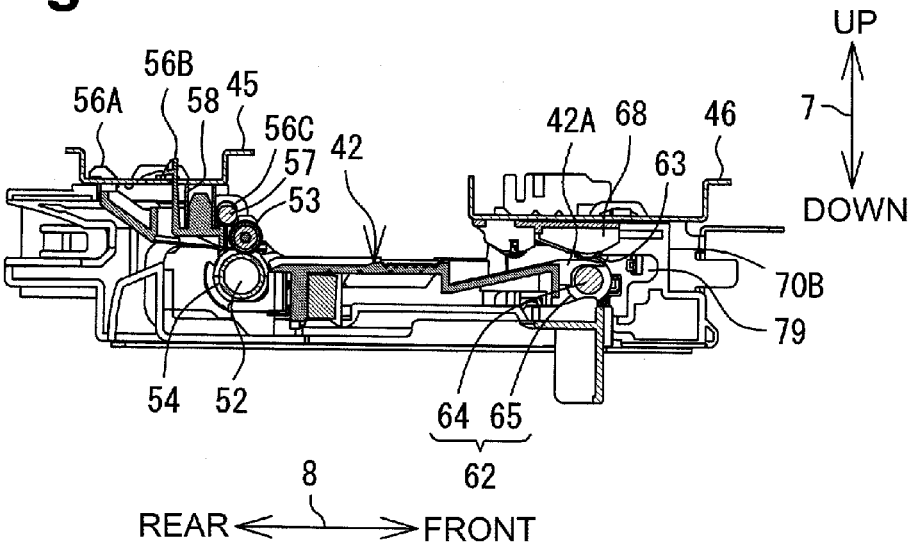

When the release rods 70A and 70B are located at the first position, the release shaft 57 may be supported by the first surface 78A of the shaft contact portion 78 as shown in FIGS. 7 and 9A. In other words, the first surface 78A of the release rod 70A at the first position is in contact with the outer surface (more specifically, the outer circumferential surface) of the release shaft 57 on one end side in the axial direction (namely, on the right side in the left-right direction 9). Meanwhile, the first surface 78A of the release rod 70B at the first position is in contact with the outer surface of the release shaft 57 on another end side in the axial direction (namely, on the left side in the left-right direction 9). In addition, the shaft 64 of the discharge roller 62 is not in contact with the retaining surface 79A and the guide surface 79B within the through holes 79 of the release rods 70A and 70B as shown in FIG. 7. As a result, as shown in FIG. 9B, the conveyor roller 52 and the pinch rollers 53 are in contact with each other, and the rollers 65 of the discharge roller 62 and the spurs 63 are in contact with each other. In addition, the platen 42 may be kept substantially horizontal.

Figure 10A:
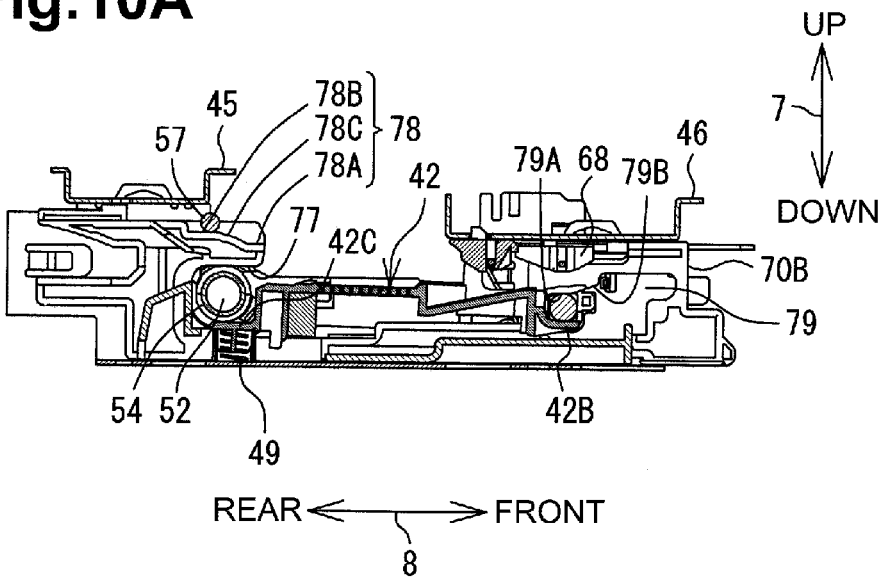
FIGS. 10A and 10B are cross-sectional views showing a state of the conveyor roller pair, the discharge roller pair, and the platen when the release rod is located at the second position.

Next, when the release rods 70A and 70B are drawn out to the second position, the conveyor roller contact portion 72 enters between the bearing 55 on the conveyor roller 52 and the release shaft 57 in the up-down direction 7. In other words, the bearing 55 enters a space defined by the base portion 71, the base portion 75, and the end portion 76. Then, as shown in FIGS. 8 and 10A, the bearing contact portion 77 may come into contact with the outer surface (more specifically, the outer circumferential surface) of the bearing 55 from above. In other words, the bearing contact portion 77 of the release rod 70A at the second position may come into contact with the outer surface of the bearing 55 which may support one end side of the shaft of the conveyor roller 52. Meanwhile, the bearing contact portion 77 of the release rod 70B at the second position may come into contact with the outer surface of the bearing 54 which may support the other end side of the shaft of the conveyor roller 52.

In addition, while the release rods 70A and 70B are drawn out to the second position, the release shaft 57 moves on the inclined surface 78C from the first surface 78A side toward the second surface 78B side. Then, when the release rods 70A and 70B reach the second position, the release shaft 57 may be supported by the second surface 78B as shown in FIGS. 8 and 10A. In other words, the second surface 78B of the release rod 70A at the second position may come into contact with the outer surface of the release shaft 57 on one end side in the axial direction thereof. Meanwhile, the second surface 78B of the release rod 70B at the second position may come into contact with the outer surface of the release shaft 57 on the other end side in the axial direction thereof.

Figure 10B:
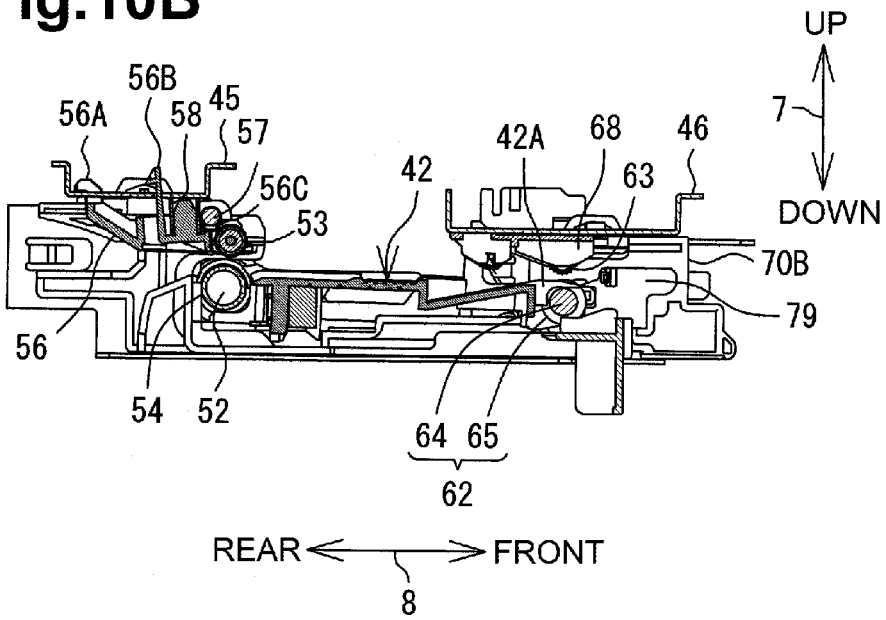

Here, while the release shaft 57 moves upwardly along the inclined surface 78C, the release shaft 57 may come into contact with the wall surface defining the hole 56C of each roller holder 56 and move each roller holder 56 upwardly against the urging force of the coil spring 58. Thus, the pinch rollers 53 move upwardly together with the roller holders 56, and may be spaced apart from the conveyor roller 52 at the time when the release rods 70A and 70B reach the second position as shown in FIG. 10B.

In addition, while the release rods 70A and 70B may be drawn out to the second position, the shaft 64 of the discharge roller 62 moves rearward within the through hole 79 and may come into contact with the guide surface 79B. Then, the shaft 64 of the discharge roller 62 may be guided by the guide surface 79B and move downwardly against the urging force of the coil spring 67. Then, when the release rods 70A and 70B reach the second position, the shaft 64 of the discharge roller 62 may be retained by the retaining surface 79A (namely, upward movement thereof by the urging force of the coil spring 67 may be restricted). Thus, the rollers 65 of the discharge roller 62 may be spaced apart from the spurs 63 as shown in FIG. 10B.

Furthermore, while the release rods 70A and 70B may be drawn out to the second position, the platen 42 rotates with its end portion on the upstream side in the conveyance direction 15 (namely, an end portion closer to the conveyor roller pair 51) as a rotation base point and with its end portion on the downstream side in the conveyance direction 15, which may be supported by the shaft 64 of the discharge roller 62, as a rotation end such that the rotation end moves downwardly together with the shaft 64 of the discharge roller 62. Then, when the release rods 70A and 70B reach the second position, the end portion of the platen 42 on the downstream side in the conveyance direction 15 may be located below the end portion thereof on the upstream side as shown in FIG. 10B. In other words, the platen 42 may be inclined downwardly toward the conveyance direction 15.

Effects of Illustrative Embodiment

According to the embodiment, by one operation of moving the release rods 70A and 70B from a first position to a second position, it is possible to space the two rollers constituting the conveyor roller pair 51 and the discharge roller pair 61, respectively, apart from each other. In addition, by moving the pinch rollers 53 and the discharge roller 62 in directions opposite to each other and rotating the platen 42 in the direction in which the discharge roller 62 moves, the conveyance path for a recording sheet 12 may be inclined. Furthermore, the opening 13 may be provided substantially on an extension of the inclined conveyance path. Thus, a recording sheet 12 jammed on the conveyance path may be easily removed.

According to the embodiment, by drawing out the feed tray 20 and the discharge tray 21 located in the tray accommodation space 107 and holding the grip portion 74 to draw out the release rods 70A and 70B toward the opening 13 side, a nip may be released, and it is possible to perform a jam process by drawing out a recording sheet 12 inclined to the opening 13 side.

According to the embodiment, by inserting the feed tray 20 and the discharge tray 21 into the tray accommodation space 107 again after the jam process, it is possible to move the release rods 70A and 70B from the second position to the first position. As a result, it is possible to prevent conveying of the next recording sheet 12 to be started in a state where the nip may be released.

In addition, when it is configured that the pinch rollers 53 may be moved upwardly and the conveyor roller 52, which may be driven by the conveyor motor, might be not moved by the release rods 70A and 70B, it is possible to prevent a decrease in conveyance accuracy.

Furthermore, in the embodiment described above, the multi-function apparatus 10 including the ink-jet recording type printer unit 11 as an example of a conveyor device has been described, but the present invention might be not limited thereto. For example, the present invention may be applied to a laser recording type printer or a feeder in an image scanner which conveys a document.

Variation

It should be noted that in the embodiment, the example has been described where the pinch rollers 53 of the conveyor roller pair 51 may be moved upwardly, the discharge roller 62 of the discharge roller pair 61 may be moved downwardly, and the end portion of the platen 42 on the downstream side in the conveyance direction 15 which may be supported by the discharge roller 62 may be moved downwardly. Thus, the straight conveyance path 34 may be inclined downwardly from the upstream side toward the downstream side in the conveyance direction 15. However, the present invention is not limited thereto.

Figure 11A:
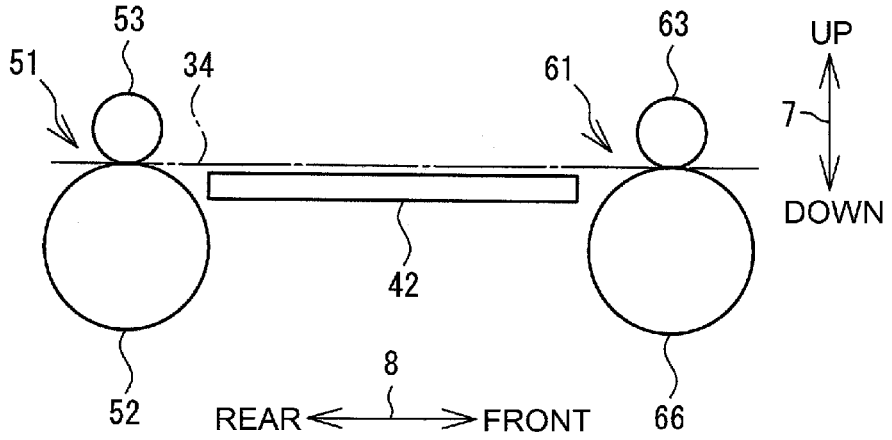
FIG. 11A is a cross-sectional view schematically showing a state of the conveyor roller pair, the discharge roller pair, and the platen in a modification when the release rods are located at the first position.
Figure 11B:
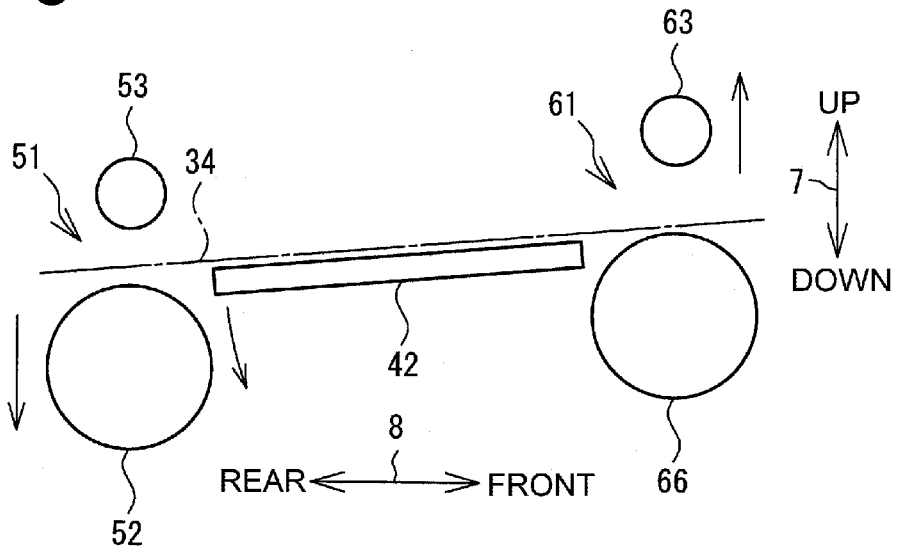
FIG. 11B is a cross-sectional view schematically showing a state of the conveyor roller pair, the discharge roller pair, and the platen in the modification when the release rods are located at the second position.

For example, when the release rods 70A and 70B (the illustration thereof may be omitted in FIGS. 11A and 11B) are located at the first position, the conveyor roller pair 51, the discharge roller pair 61, and the platen 42 may be in a state shown in FIG. 11A; and when the release rods 70A and 70B are located at the second position, the conveyor roller pair 51, the discharge roller pair 61, and the platen 42 may be in a state shown in FIG. 11B. Specifically, by moving the release rods 70A and 70B from the first position to the second position, as indicated by an arrow in FIG. 11B, the conveyor roller 52 may move downwardly to separate the conveyor roller pair 51, the spurs 63 may move upwardly to separate the discharge roller pair 61, and the end portion of the platen 42 on the upstream side in the conveyance direction 15 which may be supported by the conveyor roller 52 may move downwardly.

Thus, the straight conveyance path 34 may be inclined upwardly from the upstream side toward the downstream side in the conveyance direction 15 as shown in FIG. 11B. The user often operates the multi-function apparatus 10 from above. Thus, when an outlet for a recording sheet 12 is provided above the discharge roller pair 61 and on the downstream side in the conveyance direction 15, it is possible to easily remove a recording sheet 12 jammed within the multi-function apparatus 10.

What is claimed is:

1. A conveyor device comprising:

a first conveyor unit comprising:

a first roller configured to contact a first surface of a sheet and to be movable in a first radial direction; and a second roller configured to contact a second surface of the sheet, wherein the first roller and the second roller are configured to nip and convey the sheet along a conveyance path in a conveyance direction;

a second conveyor unit disposed along the conveyance path and comprising:

a third roller configured to contact the second surface of the sheet and to be movable in a second radial direction; and a fourth roller configured to contact the first surface of the sheet, wherein the third roller and the fourth roller are configured to nip and convey the sheet in the conveyance direction;

a support member disposed between the first conveyor unit and the second conveyor unit along the conveyance path and configured to support the second surface of the sheet; and a movable member configured to be movable between a first position and a second position and to move the first roller away from the second roller and the third roller away from the fourth roller when moving from the first position to the second position, wherein when the movable member is located in the first position, the first roller is in contact with the second roller and the third roller is in contact with the fourth roller, and when the movable member is located in the second position, the first roller is separated from the second roller and the third roller is separated from the fourth roller, wherein the support member is configured to pivot such that a portion of the support member on a second conveyor unit side moves in the second radial direction in accordance with movement of the movable member to the second position.

2. The conveyor device according to claim 1, wherein the movable member comprises:

a first contact portion configured to contact the first conveyor unit to move the first roller in the first radial direction away from the second roller when the movable member is being moved to the second position; and a second contact portion configured to contact the second conveyor unit to move the third roller in the second radial direction away from the fourth roller when the movable member is being moved to the second position.

3. The conveyor device according to claim 2, wherein the first conveyor unit further comprises:

a bearing configured to rotatably support a shaft of the second roller;

a roller holder configured to rotatably support the first roller;

an urging member configured to urge the roller holder toward the second roller; and a release shaft extending along an axis direction of the second roller and passing through the roller holder, and configured to be movable in a third radial direction, wherein, when the movable member is being moved to the second position, the first contact portion is located between the bearing and the release shaft and the first roller is moved in a direction away from the second roller by contacting an outer surface of the bearing and an outer surface of the release shaft.

4. The conveyor device according to claim 2, wherein the second conveyor unit further comprises an urging member configured to urge the third roller toward the fourth roller, and wherein the second contact portion is configured to move the third roller, against an urging force of the urging member, in a direction away from the fourth roller by contacting a shaft of the third roller when the movable member is being moved to the second position.

5. The conveyor device according to claim 1, wherein the third roller supports an end portion of the support member on the second conveyor unit side.

6. The conveyor device according to claim 1, wherein the second conveyor unit is disposed downstream of the first conveyor unit along the conveyance path in the conveyance direction, wherein the first roller is configured to contact an upper surface of the sheet, and wherein the third roller is configured to contact a lower surface of the sheet, and wherein, when the movable member is being moved to the second position, the movable member is configured to move the first roller upward and the third roller downward.

7. The conveyor device according to claim 1, further comprising a base member configured to support the first conveyor unit, the second conveyor unit, the support member, and the movable member, the base member having a space for accommodating a sheet holder, wherein the space is located downstream of the second conveyor unit in the conveyance direction and below the second conveyor unit, and wherein the second conveyor unit is configured to convey the sheet toward the space.

8. The conveyor device according to claim 7, wherein the movable member further comprises a projecting portion exposed via the space, and wherein the movable member is configured to move to the second position from the first position in accordance with movement of the projecting portion away from the second conveyor unit.

9. The conveyor device according to claim 8, further comprising a sheet holder configured to be inserted into and removed from the space, wherein the sheet holder is configured to support the sheet conveyed by the second conveyor unit when the sheet holder is placed in the space, and wherein the sheet holder, when inserted into the space, contacts the projecting portion and causes the projecting portion to move the movable member to the first position from the second position.

10. The conveyor device according to claim 1, further comprising a motor, wherein the second roller is configured to rotate by application of a driving force from the motor, and wherein the first roller is configured to rotate in accordance with rotation of the second roller.

11. An image recording apparatus comprising:

a first conveyor unit comprising:

a first roller configured to contact a first surface of a sheet and to be movable in a first radial direction; and a second roller configured to contact a second surface of the sheet, wherein the first roller and the second roller are configured to nip and convey the sheet along a conveyance path in a conveyance direction;

a second conveyor unit disposed along the conveyance path and comprising:

a third roller configured to contact the second surface of the sheet and to be movable in a second radial direction; and a fourth roller configured to contact the first surface of the sheet, wherein the third roller and the fourth roller are configured to nip and convey the sheet in the conveyance direction;

a recording head disposed along the conveyance path between the first conveyor unit and the second conveyor unit and configured to record an image onto the sheet being conveyed along the conveyance path between the first conveyor unit and the second conveyor unit; and a movable member configured to be movable between a first position and a second position, wherein when the movable member is located in the first position, the first roller is in contact with the second roller and the third roller is in contact with the fourth roller, and when the movable member is located in the second position, the first roller is separated from the second roller and the third roller is separated from the fourth roller, wherein a distance from the third roller to the recording head in the second position is greater than a distance from the third roller to the recording head in the first position while a distance from the second roller to the recording head is the same in the first position and the second position.

12. The image recording apparatus according to claim 11 further comprising:

a support member disposed between the first conveyor unit and the second conveyor unit along the conveyance path and configured to support the second surface of the sheet, wherein the recording head faces the support member, and wherein the support member is configured to pivot such that a portion of the support member on a second conveyor unit side moves in accordance with movement of the movable member to the second position.

13. The image recording apparatus according to claim 12, wherein the third roller supports an end portion of the support member on the second conveyor unit side.

14. The image recording apparatus according to claim 12, further comprising a base member configured to support the first conveyor unit, the second conveyor unit, the support member, and the movable member, the base member having a space for accommodating a sheet holder, wherein the space is located downstream of the second conveyor unit in the conveyance direction and below the second conveyor unit, and wherein the second conveyor unit is configured to convey the sheet toward the space.

15. A conveyor device comprising:

a first conveyor unit comprising:

a first roller configured to contact an upper surface of a sheet and to be movable; and a second roller configured to contact a lower surface of the sheet, wherein the first roller and the second roller are configured to nip and convey the sheet along a conveyance path in a conveyance direction;

a second conveyor unit disposed along the conveyance path and comprising:

a third roller configured to contact the lower surface of the sheet and to be movable; and a fourth roller configured to contact the upper surface of the sheet, wherein the third roller and the fourth roller are configured to nip and convey the sheet in the conveyance direction; and a movable member configured to be movable between a first position and a second position and to move the first roller away from the second roller and the third roller away from the fourth roller when moving from the first position to the second position, wherein when the movable member is located in the first position, the first roller is in contact with the second roller and the third roller is in contact with the fourth roller, and when the movable member moves to the second position, the first roller is moved away from the second roller while the second roller remains in a static position and the third roller is moved away from the fourth roller while the fourth roller remains in a static position.

16. The conveyor device according to claim 15, wherein the second conveyor unit is disposed downstream of the first conveyor unit along the conveyance path in the conveyance direction, and wherein, when the movable member is being moved to the second position, the movable member is configured to move the first roller upward and the third roller downward.

17. The conveyor device according to claim 15, further comprising a motor, wherein the second roller is configured to rotate by application of a driving force from the motor, and wherein the first roller is configured to rotate in accordance with rotation of the second roller.

18. The conveyor device according to claim 15, wherein the movable member comprises:

a first contact portion configured to contact the first conveyor unit to move the first roller away from the second roller when the movable member is being moved to the second position; and a second contact portion configured to contact the second conveyor unit to move the third roller away from the fourth roller when the movable member is being moved to the second position.

19. The conveyor device according to claim 18, wherein the first conveyor unit further comprises:

a bearing configured to rotatably support a shaft of the second roller;

a roller holder configured to rotatably support the first roller;

an urging member configured to urge the roller holder toward the second roller; and a release shaft extending along an axis direction of the second roller and passing through the roller holder, and configured to be movable, wherein, when the movable member is being moved to the second position, the first contact portion is located between the bearing and the release shaft and the first roller is moved in a direction away from the second roller by contacting an outer surface of the bearing and an outer surface of the release shaft.

20. The conveyor device according to claim 18, wherein the second conveyor unit further comprises an urging member configured to urge the third roller toward the fourth roller, and wherein the second contact portion is configured to move the third roller, against an urging force of the urging member, in a direction away from the fourth roller by contacting a shaft of the third roller when the movable member is being moved to the second position.

* * * * *